United States Patent [19]

Akashi

[11] Patent Number: 4,528,731

[45] Date of Patent: Jul. 16, 1985

[54] SLIDE FASTENER CHAIN

[75] Inventor: Shunji Akashi, Kurobe, Japan

[73] Assignee: Yoshida Kogyo K. K., Tokyo, Japan

[21] Appl. No.: 430,827

[22] Filed: Sep. 30, 1982

[30] Foreign Application Priority Data

Oct. 9, 1981 [JP] Japan ..... 56-160135

[51] Int. Cl.[3] ..... A44B 19/36

[52] U.S. Cl. ..... 24/383; 28/170; 139/407

[58] Field of Search ..... 139/407, 389 B; 28/170; 24/30.5 P, 16 PB, 383

[56] References Cited

U.S. PATENT DOCUMENTS

| | | | |
|---|---|---|---|
| 2,292,322 | 8/1942 | Huizeng | 139/407 |
| 3,081,462 | 3/1963 | Radovsky et al. | 24/383 |
| 3,322,325 | 5/1967 | Bush | 24/30.5 P |
| 3,731,349 | 5/1973 | Terado | 24/383 |
| 4,123,827 | 11/1978 | Yoshida | 24/383 |
| 4,187,591 | 2/1980 | Akashi | 24/383 |
| 4,238,872 | 12/1980 | Akashi | 24/383 |

FOREIGN PATENT DOCUMENTS 1288502 9/1972 United Kingdom .

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A slide fastener chain has a plurality of spaced separating regions along which the slide fastener chain can be separated or torn to slide fastener lengths one after another by hand without a cutting device. Each separating region extends transversely across the fastener chain and is at least partially thinned or recessed by fusing the thermoplastic synthetic materials of the fastener stringers at the prospective separating region.

12 Claims, 22 Drawing Figures

SLIDE FASTENER CHAIN

BACKGROUND OF THE INVENTION

1. Field of the Invention

The present invention relates to the production of slide fasteners, and more particularly to a slide fastener chain including a pair of fastener stringers of a continuous length.

2. Prior Art

In the manufacture of slide fasteners, it has been a common practice to cut or sever a slide fastener chain to slide fastener lengths by a special cutting device such as scissors or punch.

SUMMARY OF THE INVENTION

The present invention is an improved slide fastener chain which is capable of being separated or torn to slide fastener lengths by hand without use of any cutting device.

According to the present invention, a slide fastener chain has a plurality of separating regions spaced at predeterined distances along a pair of continuous fastener stringers and each extending transversely across the pair of fastener stringers. Each separating region is at least partially thinned or recessed by fusing the thermoplastic synthetic materials of the stringers at the prospective separating region.

It is therefore an object of the invention to provide a slide fastener chain which can be easily separated or torn to predetermined slide fastener lengths one after another by hand without use of any cutting device.

Another object of the invention is to provide a slide fastener chain having a plurality of spaced separating regions which is thin enough to be torn by hand and which is thick enough to prevent the fastener chain from being inadvertently torn at the separating regions during handling or transportation.

Many other advantages, features and additional objects of the present invention will become manifest to those versed in the art upon making reference to the detailed description and the accompanying drawings in which several preferred embodiments incorporating the principles of the present invention are shown by way of illustrative example.

DETAILED DESCRIPTION

Figure 1:
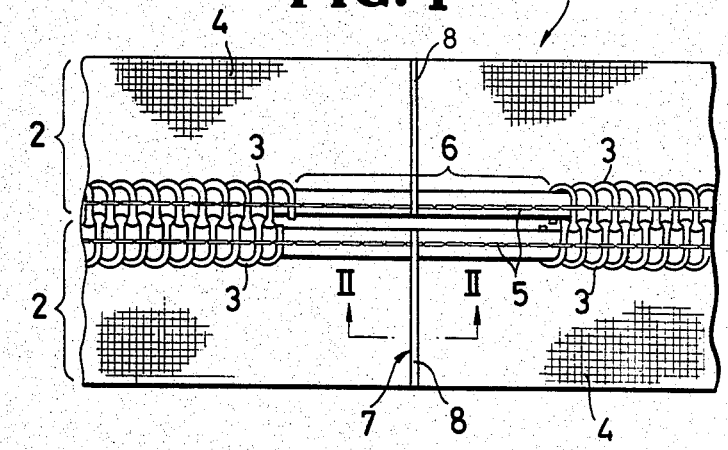
FIG. 1 is a fragmentary plan view of a slide fastener chain according to the present invention, showing only one of a plurality of spaced separating regions.

As shown in FIG. 1, a slide fastener chain 1 (hereinafter referred to as "fastener chain") comprises a pair of fastener stringers 2,2 of a continuous length including a pair of interengaged rows of coupling elements 3,3 mounted on a pair of stringer tapes 4,4 along their respective inner longitudinal edges. Each tape 4 is a woven or knit fabric made of synthetic fiber yarns, or made of blended yarns comprising natural and synthetic fibers. Each row of coupling elements 3 is in the form of a coiled or zigzag-shaped filament made of thermoplastic synthetic resin and is attached to the tape 4 by means of a line of stitching 5. The fastener chain 1 has a plurality of element-free portions 6 (only one element-free portion is illustrated for clarity) spaced at predetermined distances along the inner longitudinal tape edges.

Figure 2:
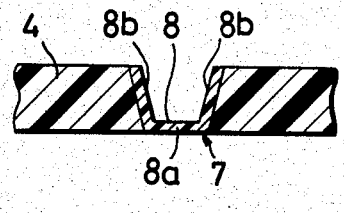
FIG. 2 is an enlarged cross-sectional view taken along line II—II of FIG. 1.

The fastener chain 1 also has a plurality of separating regions 7 (only one separating region is illustrated for clarity) along which the fastener chain 1 is to be separated or torn to individual slide fastener lengths. The separating regions 7 are spaced at predetermined distances along the fastener chain 1, each separating region 7 extending transversely across the fastener chain 1 at a respective element-free portion 6. Each separating region 7 comprises a pair of longitudinally aligned straight recesses 8,8 respectively disposed in one surface of the fastener stringers 2,2 and extending transversely thereacross. The recesses 8,8 have a trapezoidal cross section (FIG. 2), and each of such thinned or recessed portions has a uniform thickness throughout its whole length.

The recesses 8,8 may be formed by simply pressing the fastener chain 1 at the prospective separating regions 7 by a heated edge or roller (not shown), or by an ultra-high-frequency fusing device (not shown) of a known construction; the thermoplastic synthetic fibers (which are contained in the tapes 4,4) at the prospective separating regions 7 are thereby fused to constitute the walls **8*a*, 8*b* of the recesses 8,8. As a result of this fusing, the stitching threads 5,5 are broken at the recesses 8,8. The bottom wall 8*a* of each recess 8 is considerably thinner than the general thickness of the tape 4, but it is thick enough to prevent the fastener chain 1** from being inadvertently torn or broken at such recessed portions during handling or transportation.

Having the separating regions 7, the fastener chain 1 is capable of being easily torn to slide fastener lengths one after another by hand without use of any cutting device.

Figure 3:
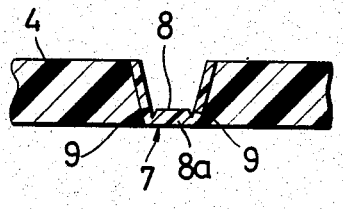
FIG. 3 is a cross-sectional view similar to FIG. 2, showing a modified separating region.

The bottom wall 8*a* of each recess 8 may have a pair of notches 9,9 (FIG. 3) extending along the corners of the recess 8 to assist separation.

Figure 4:
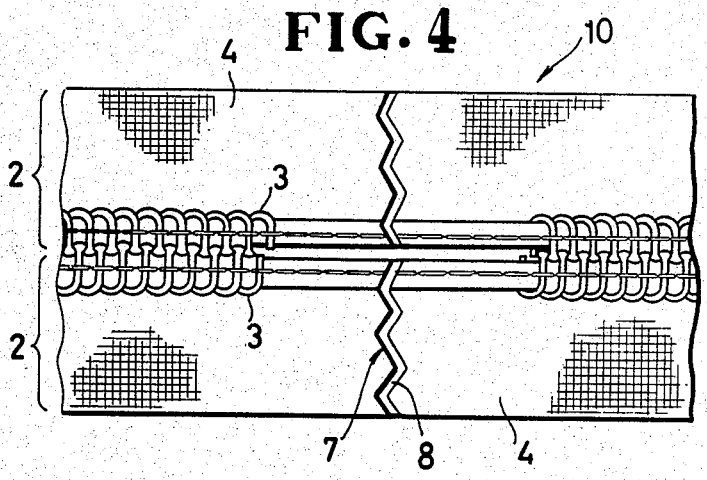
FIG. 4 is a fragmentary plan view of a slide fastener chain according to a second embodiment.

FIG. 4 shows a modified slide fastener chain 10 which is similar to the fastener chain 1 of FIG. 1 and is different therefrom only in that the recesses 8,8 of each separating region 7 extend in a zigzag course.

Figure 5:
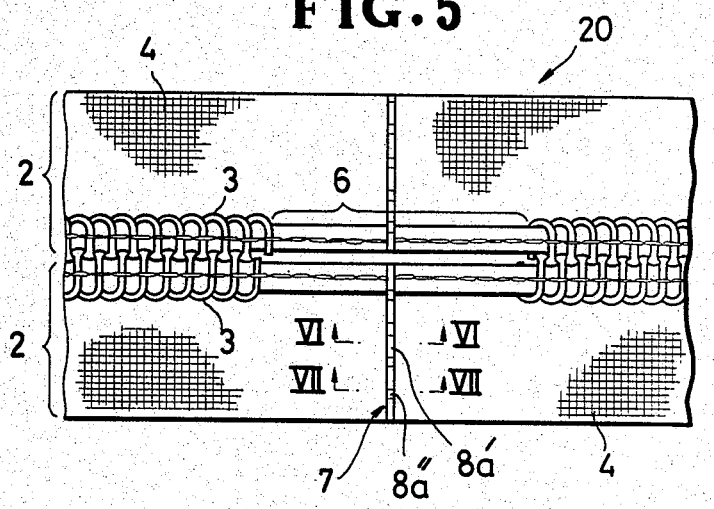
FIG. 5 is a fragmentary plan view similar to FIG. 1, showing a third embodiment.
Figure 6:
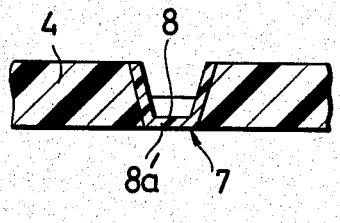
FIGS. 6 and 7 are enlarged cross-sectional views taken along line VI—VI and line VII—VII, respectively, of FIG. 5.
Figure 7:
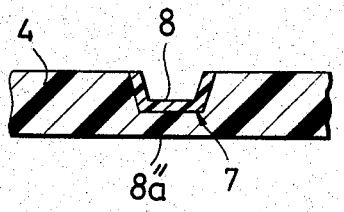

FIG. 5 shows a modified slide fastener chain 20, which is similar to the fastener chain 1 of FIG. 1 and is different therefrom only in that each recessed portion 8 comprises a plurality of long and short sections 8*a*',8*a*'' of different thicknesses disposed alternately along the recess 8. The long sections 8*a*' has a thickness smaller than the thickness of the short sections 8*a*'', as shown in FIGS. 6 and 7.

Figure 8:
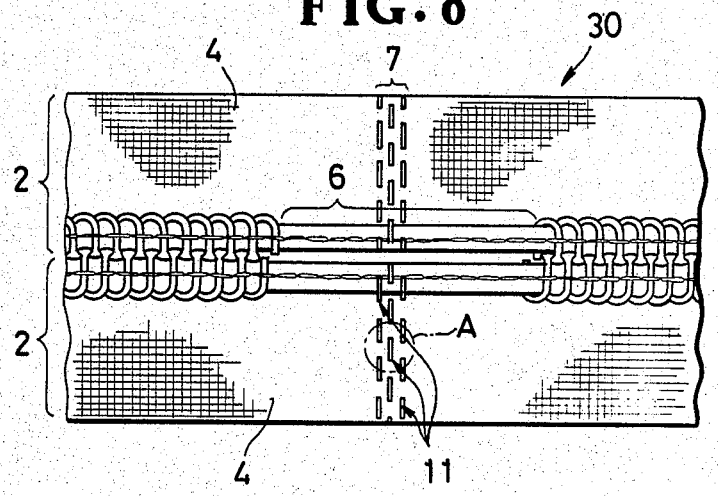
FIG. 8 is a fragmentary plan view of a slide fastener chain according to a fourth embodiment.
Figure 9:
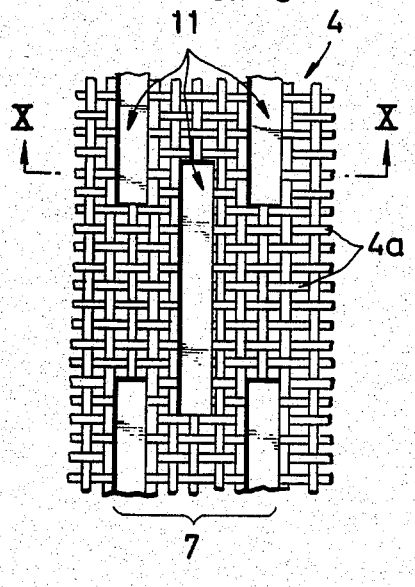
FIG. 9 is a detail view showing a portion A of FIG. 8.

FIG. 8 shows a modified slide fastener chain 30, which is different from the embodiments of FIGS. 1, 4 and 5 only in that each separating region 7 comprises three series 11,11,11 of discrete recesses disposed in one surface of the fastener chain 30 and extending transversely across the fastener chain 30. The recesses of each series 11 are virtually aligned laterally with the inter-recess portions of an adjacent series 11 and each extends beyond opposite ends of a respective inter-recess portion of the adjacent series. Thus every warp yarn 4*a* of the tape 4 is interrupted by at least one of the recesses of two of the series 11 so that the fastener chain 30 can be separated or torn along the separating region 7 without difficulty.

Figure 10:
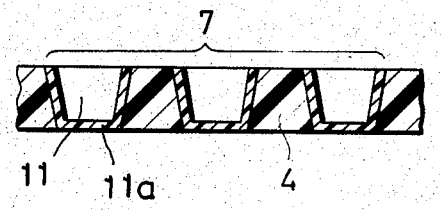
FIG. 10 is an enlarged cross-sectional view taken along line X—X of FIG. 9.
Figure 11:
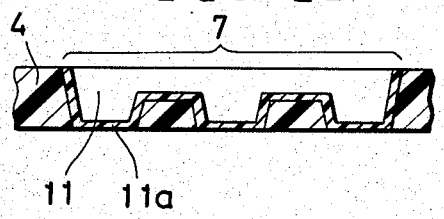
FIG. 11 is a cross-sectional view similar to FIG. 10, showing a modified separating region.

The inter-recess portions between adjacent series 11,11 have a thickness equal to the general thickness of the tape 4 (FIG. 10). Alternatively, such inter-recess-series portions may have a thickness smaller than the general thickness of the tape 4 and greater than the thickness of the recessed portion 11*a* (FIG. 11), assisting separation of the fastener chain 30 at the separating region 7.

Figure 12:
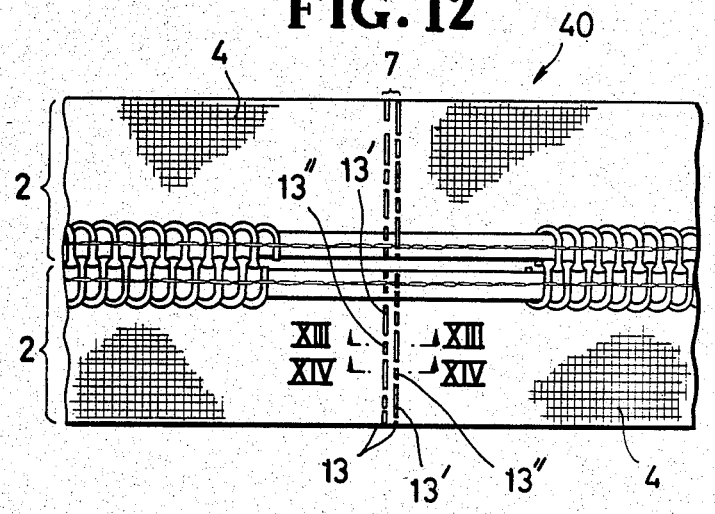
FIG. 12 is a fragmentary plan view similar to FIG. 8, showing a fifth embodiment.
Figure 13:
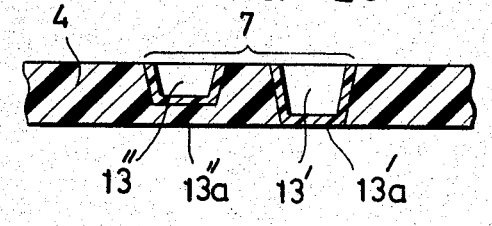
FIGS. 13 and 14 are enlarged cross-sectional views taken along line XIII—XIII and line XIV—XIV, respectively, of FIG. 12.
Figure 14:
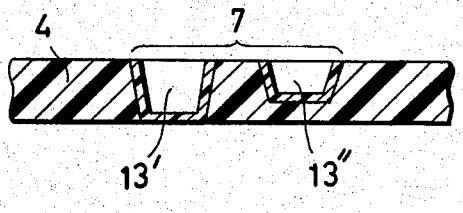

FIG. 12 shows a slide fastener chain 40, which is different from the fastener chain 30 of FIG. 8 only in that each separating region 7 comprises a pair of series 13,13 of discrete recesses disposed in one surface of the fastener chain 40 and extending transversely across the fastener chain 40. Each series 13 comprises a plurality of alternating long and short recesses 13',13'' of different thicknesses, the long recesses 13' of one series being virtually aligned laterally with the inter-long-recess portions of the other series and each extending beyond opposite ends of a respective inner-long-recess portion of the other series. The bottom wall 13''*a* of each short recess 13'' is thicker than the bottom wall 13'*a* of each long recess 13', as shown in FIGS. 13 and 14.

Figure 15:
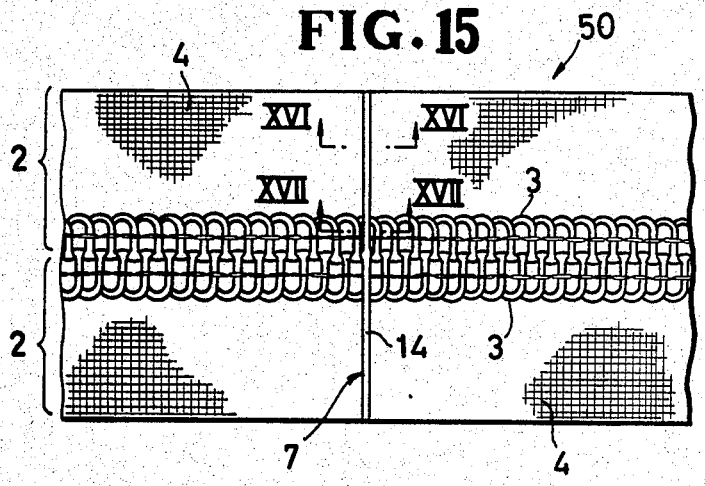
FIG. 15 is a fragmentary plan view of a slide fastener chain according to a sixth embodiment.
Figure 16:
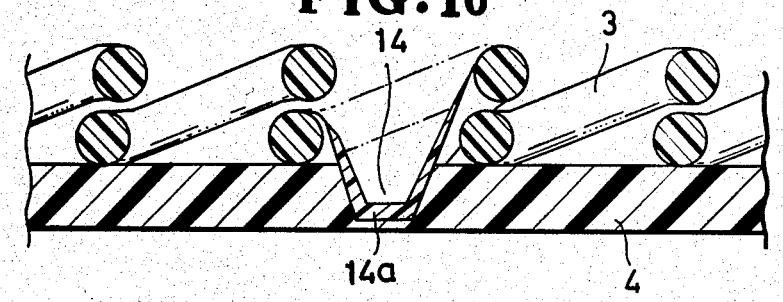
FIGS. 16 and 17 are enlarged cross-sectional views taken along line XVI—XVI and line XVII—XVII, respectively, of FIG. 15.
Figure 17:
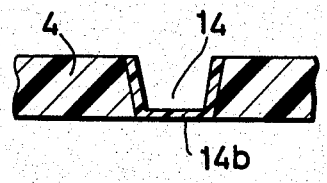

FIG. 15 shows a slider fastener chain 50, which is different from the fastener chain 1 of FIG. 1 in that in the absence of element-free portions, each straight recess 14 extends transversely across both the tape 4,4 and the coupling element rows 3,3. The recess 14 may be formed as described above; both the thermoplastic synthetic fibers (contained in the tapes 4,4) and the thermoplastic synthetic resin of the coupling elements 3 at the prospective separating region 7 are thereby fused to constitute the walls 14*a*, 14*b* of the recess 14, as shown in FIGS. 16 and 17.

Figure 18:
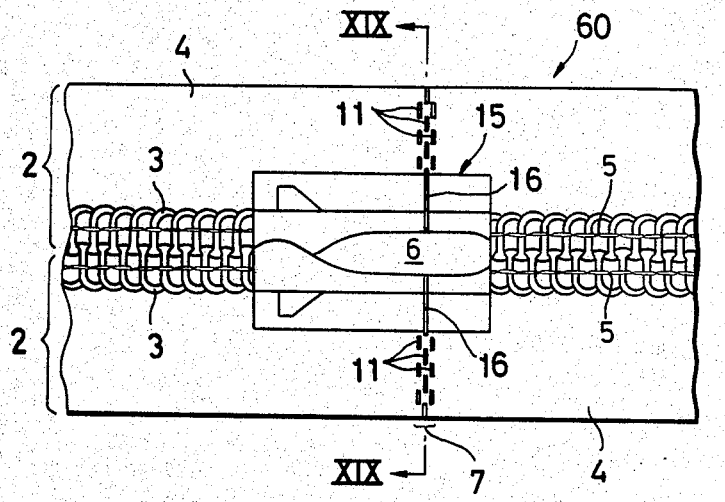
FIG. 18 is a fragmentary plan view of slide fastener chain according to a seventh embodiment.
Figure 19:
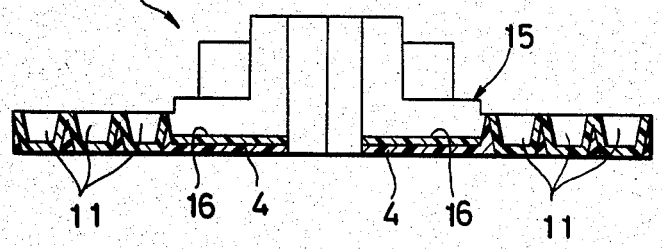
FIG. 19 is an enlarged cross-sectional view taken along line XIX—XIX of FIG. 18.

FIG. 18 shows a slide fastener chain 60, which is different from the fastener chain 30 of FIG. 8 in that a plurality of thermoplastic synthetic resin strips 15 (only one strip is illustrated for clarity) is attached to the respective element-free portions 6 (FIG. 8). The strips 15 serve to prevent the stitching threads 5,5 from fraying at the element-free portions 6. The three series 11,11,11 of discrete recesses are interrupted by the strip 15; a pair of continuous recesses 16 in the strip 15 is longitudinally aligned with one of the three series of discrete recesses 11. Thus the recesses 11 are defined by fused thermoplastic synthetic fibers of the tapes 4,4, while the recesses 16 are defined by fused thermoplastic synthetic resin of the strip 15.

Figure 20:
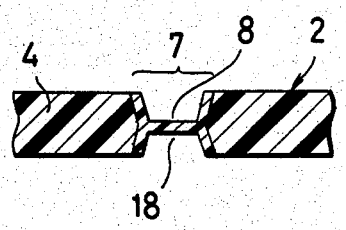
FIG. 20 is a fragmentary cross-sectional view showing a modification of the separating region of FIG. 1.

FIG. 20 shows a modification of the separating region 7 of FIG. 1, in which an additional pair of longitudinally aligned recesses 18,18 is disposed in the other surface of the respective stringers 2,2 and is aligned with the recesses 8,8, respectively, in the opposite surface of the stringers 2,2.

Figure 21:
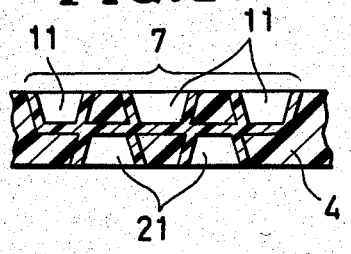
FIGS. 21 and 22 are fragmentary cross-sectional views respectively showing modifications of the separating region of FIG. 8.
Figure 22:
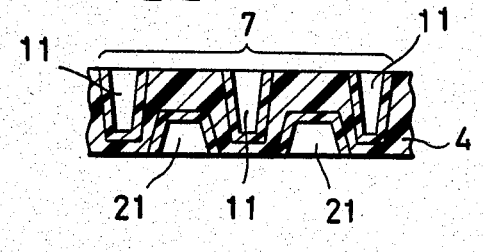

FIGS. 21 and 22 respectively show modifications of the separating region 7 of FIG. 8, in which two additional series 21,21 of discrete recesses are disposed in the other surface of the stringers 2,2 and are staggered with respect to the three series 11,11,11 of recesses in the opposite surface of the stringers 2,2.

In any of the embodiments described above, every warp yarn of the tape is interrupted by at least one of the recesses so that the fastener chain can be easily separated or torn along the separating region 7 by hand. If there are some warp yarns remaining uninterrupted or totally unfused, easy and proper separation cannot be achieved. Further, because of such totally unfused warp yarns the separated or torn ends of the tape would be unsightly.

Although various minor modifications may be suggested by those versed in the art, it should be understood that I wish to embody within the scope of the patent warranted hereon, all such embodiments as may reasonably and properly come within the scope of my contribution to the art.

What is claimed is:

1. A slide fastener chain comprising:

(a) a pair of fastener stringers of a continuous length including a pair of continuous stringer tapes and a pair of rows of coupling elements mounted on said stringer tapes along their respective inner longitudinal edges; and (b) said pair of fastener stringers having a plurality of separating regions along which the slide fastener chain is to be torn to a predetermined slide fastener length, said separating regions being spaced at predetermined distances along said pair of fastener stringers, each separating region extending transversely across said pair of fastener stringers and being at least partially thinner than that adjacent portions of said tapes, each said separating region including a pair of longitudinally aligned recesses, each recess being disposed in one surface of a respective one of said fastener stringers and extending transversely across said one fastener stringer, walls of said recesses including fused thermoplastic synthetic materials.

2. A slide fastener chain according to claim 1, each said separating region comprising a plurality of long and short recesses of different thicknesses disposed alternately along each said separating region, said long recesses having a thickness smaller than that of said short recesses.

3. A slide fastener chain according to claim 1, each of said separating regions extending in a straight course.

4. A slide fastener chain according to claim 1, each of said separating regions extending in a zigzag course.

5. A slide fastener chain according to claim 1, each said separating regions having a pair of notches extending along a pair of corners, respectively, of said recess.

6. A slide fastener chain according to claim 1, each said separating region including at least two series of discrete recesses disposed in one surface of said pair of fastener stringers and extending transversely across said pair of fastener stringers, walls of said recesses including fused thermoplastic synthetic materials.

7. A slide fastener chain according to claim 6, said recesses of one series being substantially aligned laterally with inter-recess portions of the other series and each extending beyond opposite ends of a respective one of the inter-recess portions of said other series.

8. A slide fastener chain according to claim 6, each series of said recesses comprising a plurality of alternating long and short recesses of different thicknesses, said long recesses of one series being substantially aligned laterally with inter-long-recess portions of the other series and each extending beyond opposite ends of a respective one of the inter-long-recess portions of said other series.

9. A slide fastener chain according to claim 6, portions of said fastener stringers between said two series of recesses having a thickness greater than the thickness of said recesses and smaller than the general thickness of said tapes.

10. A slide fastener chain according to claim 6, each said separating region including at least one additional series of discrete recesses disposed in the other surface of said pair of fastener stringers and staggered with respect to said two series of recesses in said one surface of said pair of fastener stringers.

11. A slide fastener chain according to claim 6, including a plurality of spaced thermoplastic synthetic resin strips attached to one surface of said pair of fastener stringers, one of said two series of discrete recesses of each said separating region extending transversely across a respective one of said strips.

12. A slide fastener chain according to claim 1, each said separating region including an additional pair of longitudinally aligned recesses, each disposed in the other surface of said respective one fastener stringer and aligned with each said recess in said one surface of the same fastener stringer.

* * * * *